United States Patent [19]

Goodman et al.

[11] 4,419,949

[45] Dec. 13, 1983

[54] FABRIC ALIGNING METHOD AND APPARATUS

[75] Inventors: Thomas P. Goodman, Palatine; Chieh-Kung Yin, Hawthorn Woods; Robert L. Kosrow, Hoffman Estates, all of Ill.

[73] Assignee: Union Special Corporation, Chicago, Ill.

[21] Appl. No.: 262,271

[22] Filed: May 11, 1981

[51] Int. Cl.[3] ..... D05B 97/00; D05B 35/10

[52] U.S. Cl. ..... 112/262.1; 112/121.11; 112/153

[58] Field of Search ..... 112/262.1, 153, 121.11, 112/306, 314, 136

[56] References Cited

U.S. PATENT DOCUMENTS 3,970,014 7/1976 Chano et al. ..... 112/121.11

4,086,860 5/1978 Kosrow et al. ..... 112/153

*Primary Examiner*—Peter P. Nerbun

*Attorney, Agent, or Firm*—John A. Schaerli; John W. Harbst

[57] ABSTRACT

An apparatus and method for aligning fabric edges which includes a microprocessor, a photocell array, A/D converter and multiplexer. Various readings of the photocell array are made during the cycle. These readings are recorded and in conjunction with others made during the fabric edge alignment step, are employed to determine when the fabric edges are aligned.

11 Claims, 10 Drawing Figures

FABRIC ALIGNING METHOD AND APPARATUS

FIELD OF THE INVENTION

This invention relates to a method and apparatus for detecting and aligning predetermined features of a fabric piece and, preferably, two of such pieces. More particularly, it relates to a microprocessor controlled apparatus and method which performs a series of precedures whereby aligning fabric pieces in a predetermined manner.

BACKGROUND OF THE INVENTION

Side seaming, top/bottom matching and edge guiding are all functions presently being performed in the manufacture of apparel. For example, all of these functions are performed in the joining of the front and back half of a pant panel via an automatic apparatus. The patent to Kosrow et al. U.S. Pat. No. 4.086,860 which issued May 2, 1978 discloses such a device. In operation, an operator manually aligns the top edges of the fabric panels and inserts the side edges into an aligner means. The aligner means then, during an automatic sequence, aligns the side and bottom edges of the fabric plies in a predetermined manner.

SUMMARY OF THE PRESENT INVENTION

The invention hereunder consideration is an improved aligner which includes a means and method which automatically determines and records the background infra-red energy level prior to insertion of the garment into the aligner and again after insertion. These readings are taken each work cycle. This is such that variation in the background infra-red energy level, due either to changes in the source or the properties of the fabric plies from work cycle to work cycle can be eliminated.

At the point where the fabric is inserted, the sequence of events call for a determination of the upper threshold level. That is, all sensors in the photo array are covered, i.e. darkness, with the subsequent recordation of that infra-red energy level. This data, the background energy level and darkness energy level, are employed during the sequence of events incident to the physical alignment of the actual fabric edges at the bottom of the fabric plies. Further steps are undertaken once actual alignment is achieved to prevent slippage or stretching of, for example, knit garments, during the start-up acceleration period, of the sewing machine. After release of the garment from the aligner, a final step includes guiding the remaining unsewn portion under the needle.

Therefore, an object of this invention is to provide an apparatus for edge alignment which includes a formation of infra-red sensitive arrays on a common substrate having intimate sensor/amplifier connections in combination with a multiplexer and A/D converter. It is yet another object of this invention to provide a means having a light sensitive array which calculates background infra-red energy level and establishes a threshold therefore after each work cycle. Still another object of this invention is to provide an apparatus and method for a light sensitive array which calculates an energy level which represents all members of said array being covered during each work cycle. But another object of this invention is to provide a microprocessor in combination with an energy sensitive array which can read each and every sensor in the array independently and determine whether energy transmission to the sensor being read is being interrupted. Another object of this invention is to provide an apparatus and a means which after the edge alignment step and prior to the sewing step, reduces tension on the fabric being sewn in order to avoid the detrimental results of sudden tensioning caused by the sewing machine acceleration on the fabric plies. Still another object of this invention is to provide a means as well as apparatus which includes a sensor system which measures differences in energy levels, such differences being produced by fabric panels, differences in the dye of the fabric panels, differences in density of the fabric panels, or whatever factor which is sufficient to produce a change in the energy level transmitted from the sensor to the receptor.

DETAILED DESCRIPTION OF THE DRAWINGS

The above description as well as further objects, features and advantages will be appreciated by reference to the following detailed description of an embodiment in conjunction with the accompanying drawings, wherein.

DETAILED DESCRIPTION OF THE PRESENTLY PREFERRED EMBODIMENT

Figure 1:
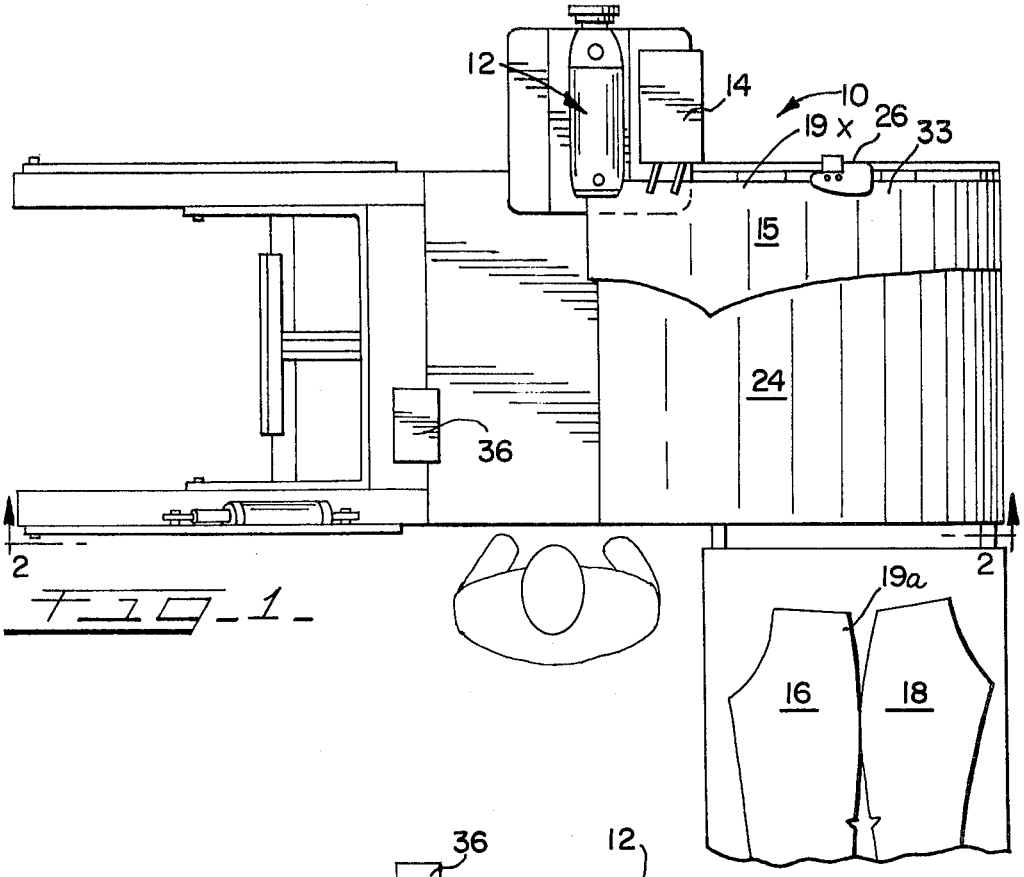
FIG. 1 is a plan view of the contour seamer assembly showing the aligner means having the fabric panels positioned therein and beginning to sweep down along the edge of the panels.
Figure 2:
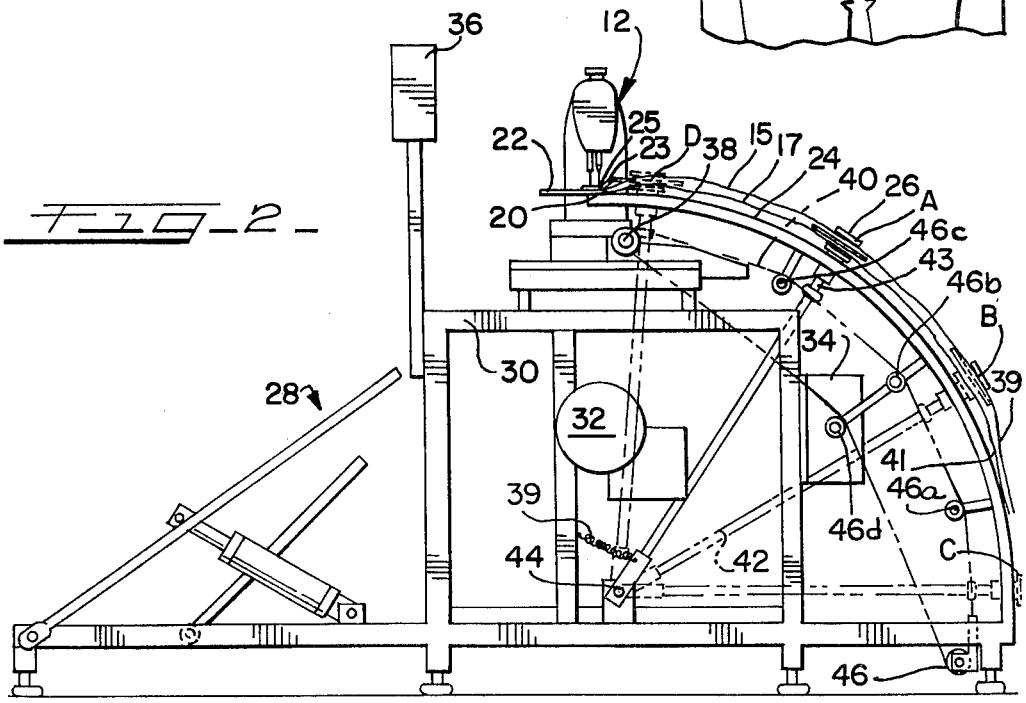
FIG. 2 is a side view of the apparatus of FIG. 1 taken along the Lines 2—2 of FIG. 1.

Referring now to the drawings, and more particularly, to FIGS. 1 and 2, there is shown an apparatus for joining together two pieces of fabric after they have been aligned in a predetermined manner. This apparatus is referred to generally as a contour seaming means 10. It is employed for the joining together of two pieces of fabric, for example pant panels or plies along their respective long edges. That is, the seam from the waistband to the bottom cuff or edge. Included in the contour seaming means combination in a sewing machine means 12 of a commercially available type such as manufactured by Union Special Corporation and identified as a style 56300 or style 39800. To the right side of the sewing machine 12 is a fabric guiding means 14 which automatically guides pieces of fabric under the needle of the sewing machine for stitching. Such automatic guiding means are known in the art as evidenced by the patent to Conner, U.S. Pat. No. 3,636,898. Briefly, however, as the feed dog means 20 of the sewing machine 12 pull the fabric plies such as 15 and 17 (plies 16 and 18 awaiting loading), the guide means 14 automatically positions the fabric back and forth in compliance with the general contour of the side edge 19 of the fabric which are normally slightly curved as is side 19*a* of ply 16. The result being that a longitudinally extending line of stitches is produced at a predetermined distance from and along the side ede of the fabric panels. For a complete understanding of the guidance means 14, reference should be made to the above-identified Conner patent.

Directly adjacent to the throat plate means 22 is provided a curved table means 24. With this preferred embodiment, the pull of gravity can be employed to aid and assist the fabric aligner means 26 to smooth and straighten the fabric panels.

To the left of the contour seaming apparatus is a stacking apparatus 28 (only partially shown). The stacking apparatus 28 can be of any convenient or appropriate design and simply facilitates the overall automation of the side seaming operation.

Also carried by the frame means 30 is a first motor means 32 for driving the sewing machine 12, a control panel 34, and a microprocessor unit 36. A second motor means 38 drives a belt means 40 which in turn is secured to arm 42. In operation arm 42 pivots around support shaft 44 such that the aligner means 26, secured to the top end 43 of arm 42 generally follows the surface of the curved table 24. Sprocket means 46, 46*a*, 46*b*, 46*c* and 46*d* provide support for the belt means 40 in order to effect the necessary support to allow this action.

The microprocessor system means 36 includes at least a logic board means, a microprocessor board means, and a front panel board. The logic board means includes, as well as the logic circuitry, the A/D converter circuitry and multiplexer means, D/A, latches, counters and timers circuitry. All of these boards being packaged within the structure of the microprocessor system means 36.

Figure 3:
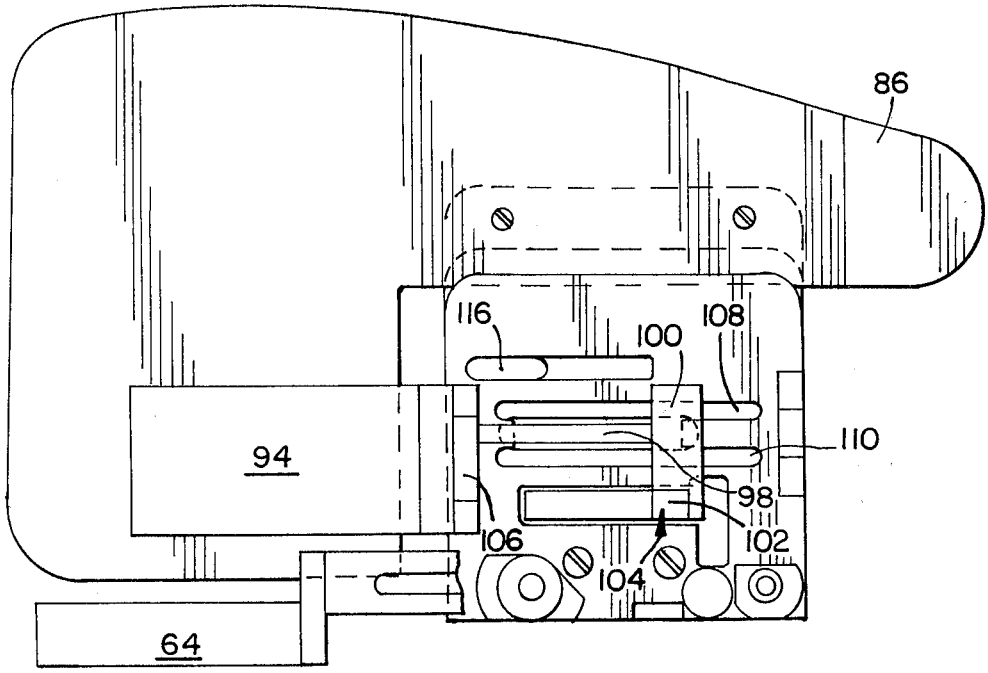
FIG. 3 is a partial top view of the aligner means showing the locations of the various sensors.
Figure 4:
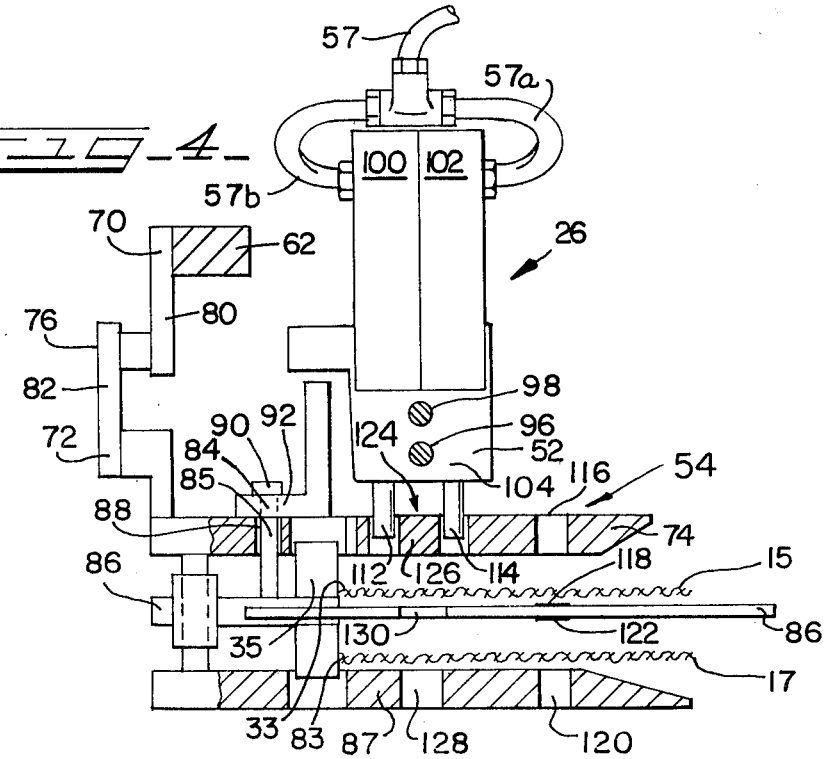
FIG. 4 is a partial side view of the apparatus of FIG. 3.
Figure 7:
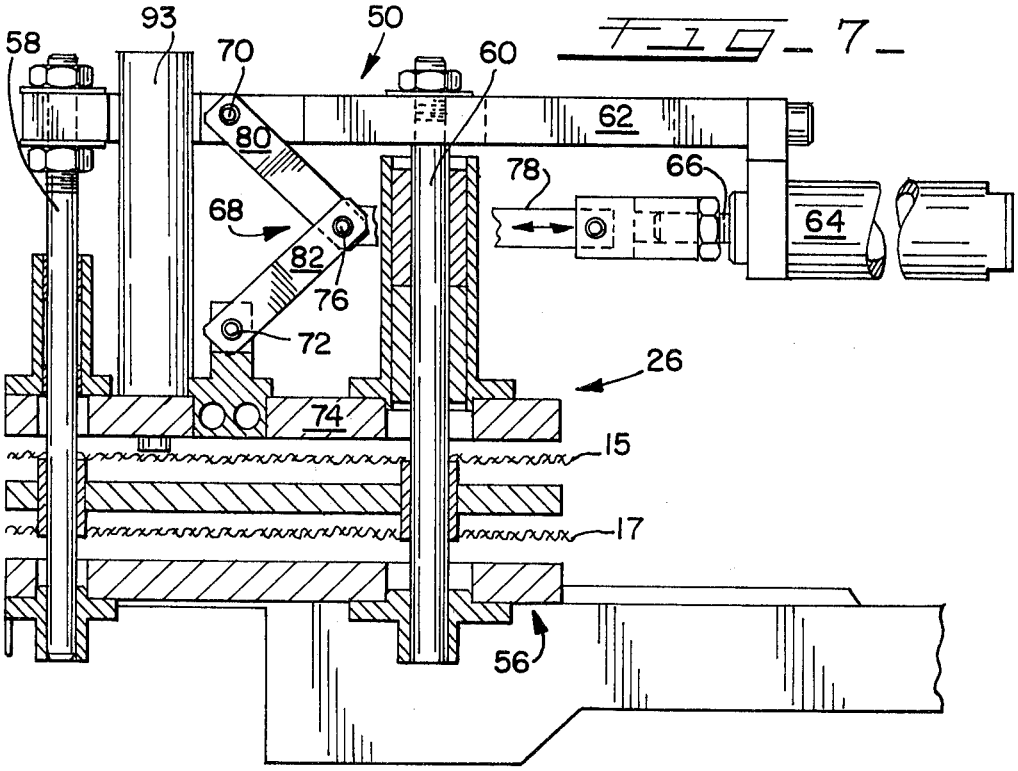
FIG. 7 is a partial cross-sectional view from the back or left side of the aligner shown in FIG. 4.

Referring now to FIGS. 3, 4, 7 and 8 wherein the fabric aligner means 26 will be more fully developed. It should be appreciated that the view shown in FIG. 3 is from point x in FIG. 1 looking down. FIG. 4 is a partial view of FIG. 3 looking from right to left. Included within the fabric aligner means is a fabric aligner closing means 50, a fabric clamping and moving means 52 which has position feedback to the microprocessor, and various energy transmitter means and receiver means which comprise a sensor assembly means 54. The energy transmitter means include a constant current source and the sensor assembly means 54 has decoding and multiplexing abilities. Referring to FIG. 7, the aligner means 26 includes a main frame 56, which is secured to the top end 43 of arm means of 42 and has an electronic box and cable running with the arm. As seen in FIG. 1, the arm means 42 is biased under the influence of a spring 39, the purpose of which will be described hereinafter.

Supported on the main frame 56 is the fabric aligner closing means 50, which includes; two vertical guide rods 58 and 60, and a top support plate 62 which is fixed to the vertical guide rods 58 and 60 so that it maintains a permanent position with respect to the support plate 56. Suspended from the top plate 62 is a double acting air cylinder 64 which has its rod end 66 connected to a scissor mechanism 68. A first end 70 of the scissor means 68 is pivotally connected to the top plate 62, while a second end 72 is pivotally connected to the top plate 74. A third pivot point 76 is provided at the juncture of the rod end 66 and linkage mechanism 78, and the two arms 80 and 82 of the scissor mechanism. In operation, as the rod end 66 of the double acting cylinder moves from the right to the left, the plate 74 is vertically moved along the guide rods 58 and 60. Referring to FIG. 4 wherein is shown a shoulder screw 84 that has the lower end of its shaft 85 connected to the center plate 86. The shaft portion 85 of the shoulder screw passes through an aperture 88 in the top plate such that there is no frictional contact therebetween. As the top plate 74 rises, however, at a predetermined point the cap 90 of the shoulder screw 84 "bottoms out" on the surface 92 resulting in the fact that the center plate 86 follows the upper plate 74 in its vertical travels.

Figure 6:
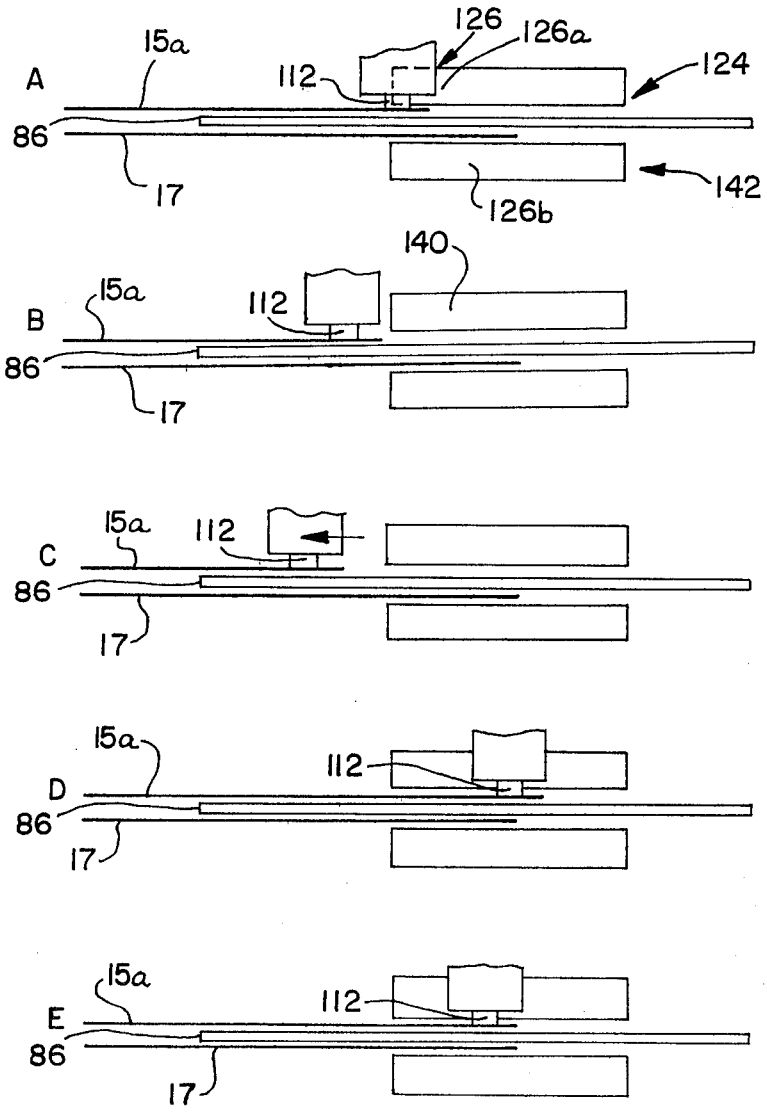
FIG. 6 is a partial schematic view representing the panel alignement steps when the top panel is shorter.

The clamping and aligning of the respective fabric ends is accomplished by the fabric clamping and moving means 52 as better shown in FIGS. 3 and 4. Included within this combination is a motor means 94, a lead screw and guide shaft means 96 and 98, and first and second air cylinder means 100 and 102. A support frame means 104 carries the air cylinders 102 and 100 and also provides the necessary cooperation for the lead screw 96 and the guide rod or shaft 98. Air line means 57*a* and 57*b* are connected to a common air source 57 such that the pressure exerted by the cylinders 102 and 100 is generally the same. Additionally, a certain amount of freedom exists between the support frame 104 and both the screw mean 96 and the guide rod 98 to compensate for other minor pressure differences. In operation, the motor means 94 drives the lead screw means 96 via a sprocket system 106 such that the entire assembly comprising the air cylinder 100, air cylinder 102, and support block 104 are moved either to the left or the right as shown in FIG. 3. Elongated slots 108 and 110 are provided in the top plate 74 to allow the passage of the piston ends 112 and 114 of air cylinders 100 and 102. In operation, in response to signals from the sensor system 54 (as will hereafter be discussed) the air cylinders 100 and 102 are actuated to clamp fabric between the ends of the rods 112 and 114 and the center plate 86 at different points on the surface of the fabric. Thereafter, in accordance with the aligning program, the motor means 94 is actuated such that the air cylinder 100 ansd 102 as well as the support block means 104 slides the trapped fabric such that the bottom edge (or edge to be aligned) is moved generally perpendicular to the major axis of the photo array means 124, as shown in FIG. 6, and parallel to the plane occupied by the fabric ply itself. It is imperative that the edge to be aligned be moved from its initial rest position, where its side edge 33 is aligned with the edge guide means 35, and the bottom edge 39 (shown in FIG. 2) is perpendicular thereto, to a position where it is aligned with the bottom edge 41 (shown in FIG. 2) of the bottom ply 17. The bottom ply 17 has its side edge 83 aligned with the edge guide 35 and its bottom edge 41 perpendicular thereto.

The provision of the two spaced apart pressure exerting means represented by the rods 112 and 114 which straddle the photo cell array 124 assure proper workpiece orientation. That is, the spaced apart pressure points insure that the side edge 33 is aligned with the edge guide 35 and that the bottom edge 39 is perpendicular thereto after being moved by the aligner means 26 to an aligned position with respect to the bottom fabric ply 17.

The actuation of the fabric aligner clamping means 50 occurs after the insertion of the fabric into the aligner means 26. The fabric clamping and moving means 52 is actuated in response to information provided by the sensor system means 54 to the microprocessor unit 36. The microprocessor employs this information through various predetermined routines to effect the proper aligning of the respective fabric ends. The sensor means 54 includes a top end ply sensor means 116 with a corresponding reflector means 118, a bottom end ply sensor means 120 and corresponding reflector means 122, and a photocell array 124 that includes a transmitter means, and a hall effect sensor and its magnetic means. The photoarray means 124 includes a series of as many as twenty separate sensor units, such as 126, each comprising a transmitter means, such as 126*a*, and a detector means, such as 126*b*, as seen in FIG. 6. In order to achieve optimum detection of the fabric edge, it is preferred that there is only a minimum amount of space between each of the sensor units. Each of the units is so connected to the microprocessor that the energy level between the transmitter and detector of each sensor unit can be continuously monitored. An elongated slot 130 is provided in the center plate 86 to allow for the needed energy transmission.

As is apparent from a consideration of FIGS. 2 and 4, the top fabric ply is positioned initially between the top of the plate 74 and the middle plate 86. The other fabric ply is positioned between the lower plate 87 and the middle plate 86.

Figure 8:
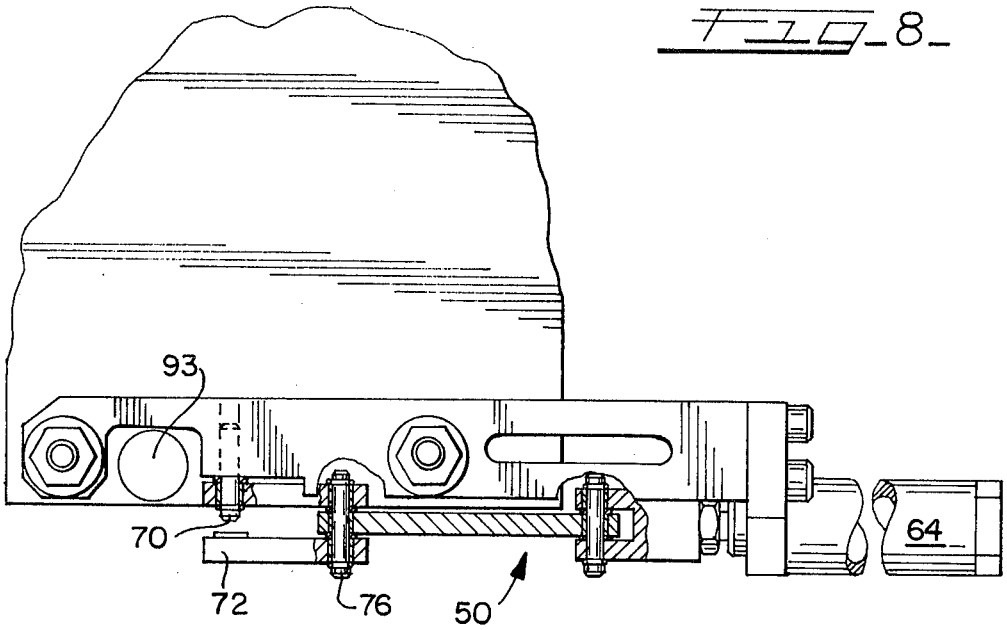
FIG. 8 is a top view of the aligner means as shown in FIG. 7.
Figure 9:
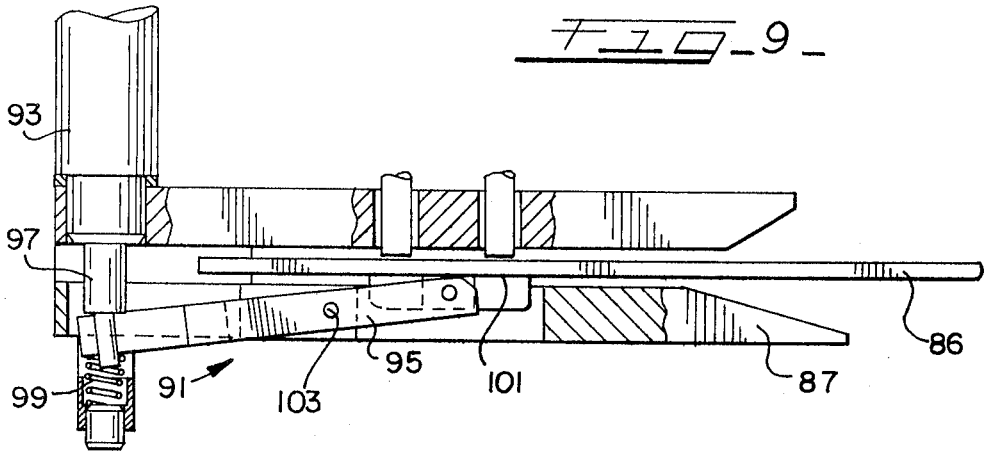
FIG. 9 is a partial cross-sectional view of the lower primary fabric clamping means.
Figure 10:
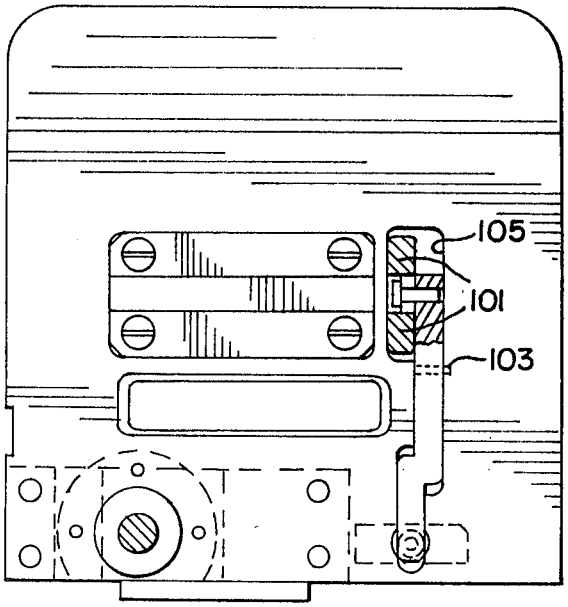
FIG. 10 is a partial top view of the lower primary fabric clamping means.

The lower primary fabric clamping means 91 is shown in FIGS. 8, 9 and 10. As seen in FIG. 8, a pneumatic cylinder 93 controls the movement of an arm means 95 as seen in FIG. 9. Referring to FIG. 9, arm means 95 responds to the urging of rod means 97 against spring means 99, to move the fabric engaging surface means 101 into contact with the fabric ply located between the plates 86 and 87. The arm means pivots around pivot shaft 103, which is secured to the lower plate 87 by any convenient means. Referring to FIG. 10, it is apparent that the fabric engaging surface means 101 passes through an aperture means 105 in lower plate 87 in order to fixedly secure the fabric ply between it and the middle plate 86.

Mode of Operation

The machine can be initialized when the power is turned on, or when the reset button on the front panel is actuated. In any event, the microprocessor means 36 will go into a restart mode. The restart mode defines the existing state of all major input/output sensors at that given point in time. There is then a known predetermined state for all sensors, solenoids, motors, etc. The restart mode defines or determines this information for subsequent employment in the initialization cycle. As employed herein, the term mode defines the state of operation in which the machine is in at any given time during the work cycle. A routine is defined as a set of instructions for the microprocessor which are designed to perform a specific operation.

The work of the restart mode having been completed, its last function is to jump to the executive control mode. The executive mode controls through the subroutine, the actual movement of the hardware in the machine. The subroutine modes read input/output sensors and decide the function which should or should not happen, etc. They feed this data to the executive mode which compares the various pieces of data to other information and makes the ultimate decision as to what should happen. The executive mode controls; the home mode, the rest mode, the sweep-down mode, the alignment mode, the sew-up mode, the service mode, and the stack mode.

The executive mode, having analyzed the varying existing conditions as provided by the restart mode, makes certain decisions and in the proper operation of the program next goes on to the home mode.

The home mode is primarily concerned with moving all of the mechanical hardware into the proper position to accept the fabric plys and initiate the next step. An additional function which it performs is to channel the analog voltage data of the photocell array means through the multiplexer means and the A/D converter means when the photo array is not covered by, or interrupted by, fabric. A background infra-red energy level in the form of an 8 bit data word is determined for each sensor unit means. The home mode then sends messages and needed information to the executive mode or elsewhere such that the information is either used immediately or stored for future use.

The fabric aligner means 26 is now ready to accept the fabric plies. The executive mode, based upon the information provided by the home mode, goes to the next mode which is the rest mode. This mode is primarily concerned with the determination of whether the fabric plies are properly positioned within the aligner means 26 in order that the actual work cycle can be initiated. Among the items the reset mode checks for proper positions are the following: slow sew, trailing edge sensors and whether the presser foot is up. The operator, in any convenient manner, positions the leading edge 23 of the fabric plies 15 and 17 under the presser foot 25 a suitable midportion of each then being situated between the jaws 74, 86 and 87 of the aligner means 26. Then, in response to either manual actuation by the operator, or if in an automated mode after a predetermined time lapse, the mode is incremented to the sweep mode.

The major function of the sweep mode is to move the aligner means to the ends of the fabric plies, to detect those ends and to fire the appropriate one of the fabric clamping and moving means 52 in the proper sequence. Additional physical functions which are also performed includes; the presser foot is lowered, the presser foot clamp is actuated, and the speed of the sweep-down of the aligner means 26 is determined for future use depending on whether this is the initial learn cycle or a subsequent run. Additionally, the analog value of the photocell array through the multiplexer and A/D converter is reestablished when the transmission of energy between the transmitter and the receptor means of each sensor is interrupted by the presence of the two fabric plies. That is, another 8 bit data word is created and recorded. Broadly speaking, a covered infra-red energy level and an uncovered infra-red energy level are generated for each individual sensor means unit. The digitized values thereof in the form of 8 bit data words levels are employed to create a table against which subsequently read and converted energy infra-red levels are compared. As a result, the microprocessor system is able to determine whether these subsequently read energy levels represent a cover or uncovered state for that individual sensor unit. In actual operation, the photocell array is scanned as the aligner means 26 sweeps down the side 33 of the fabric plys. The speed of the sweep-down is determined by the microprocessor and depends on whether or not this is the first run or subsequent run on fabric plies of this particular length. If it is the first run, the sweep-down of the aligner means 26 proceeds at a slower rate until one or the other of the fabric end sensor means 116 or 120 are uncovered. This length determination of the fabric plies is stored so that in future runs of plies of this length, it will cause the sweep-down to be substantially faster and then slow down just prior to where the last end point was. That is, the sweep arm means 42 will move at a very high speed, anticipate the end point of the fabric plies and slow the aligner means 26 down appropriately.

As soon as one of the end sensor means 116 or 120 is uncovered, a predetermined further distance is swept out by the aligner means 26. For example, once either sensor means is uncovered, the aligner is moved one inch further and the fabric clamp associated with the uncovered sensor is then fired. The uncovering of the sensor causes a change in the infra-red energy level transmission which is detected by a predetermined sensor unit 140 of the photoarray 142. The occurance of this event will cause the other fabric clamp to be fired. The last event which occurs in the sweep mode is that the ply length information is stored and a command is given to the executive mode to proceed to the next mode.

The next mode is called the align mode. And, as the title implies, it is during this mode that the two fabric plies, as 15 and 17, are positioned such that their trailing edges are aligned. The first step which is performed is to release tension on the fabric panels. That is, the aligner means 26 is moved upwardly just enough to release the tension in the fabric plies 15 and 17.

The aligner means 26 is capable of moving only the top fabric ply 15 with respect to the bottom fabric ply 17. For the sake of explanation, let it first be assumed that the top ply 15*a* is shorter. This assumption corresponds to the situation shown in FIG. 6 of the drawings. Prior to the movement of the fabric panels, the photo array 124 is scanned and an energy level measures for each sensor unit means is taken and recorded. The top panel 15*a* is then moved a predetermined distance or first to the left, as shown in "B" of FIG. 6. During this movement, the total photo array is scanned to determine if any sensor unit has had a change in energy level. If there is no change in energy level after a predetermined distance to the left, as shown in "C" of FIG. 6, the fabric panel is moved back to its initial position and then to the right a distance. Here again, during the move the photo array is scanned to determine any changes in the energy level measured by any of the sensor units. As soon as the top ply is moved to the right of the longer bottom ply, as in "D" of FIG. 6, a sensor unit which was previously uncovered is covered with the corresponding change in infra-red energy level transmission. This point represents an over shot so the ply is moved back a predetermined distance or to a point of alignment shown in "E" of FIG. 6. In short, the top ply is moved as long as there is no change in energy level detected by any individual sensor unit means in the photo array. As soon as a change is detected, the microprocessor system determines that the fabric ply ends are aligned.

Figure 5:
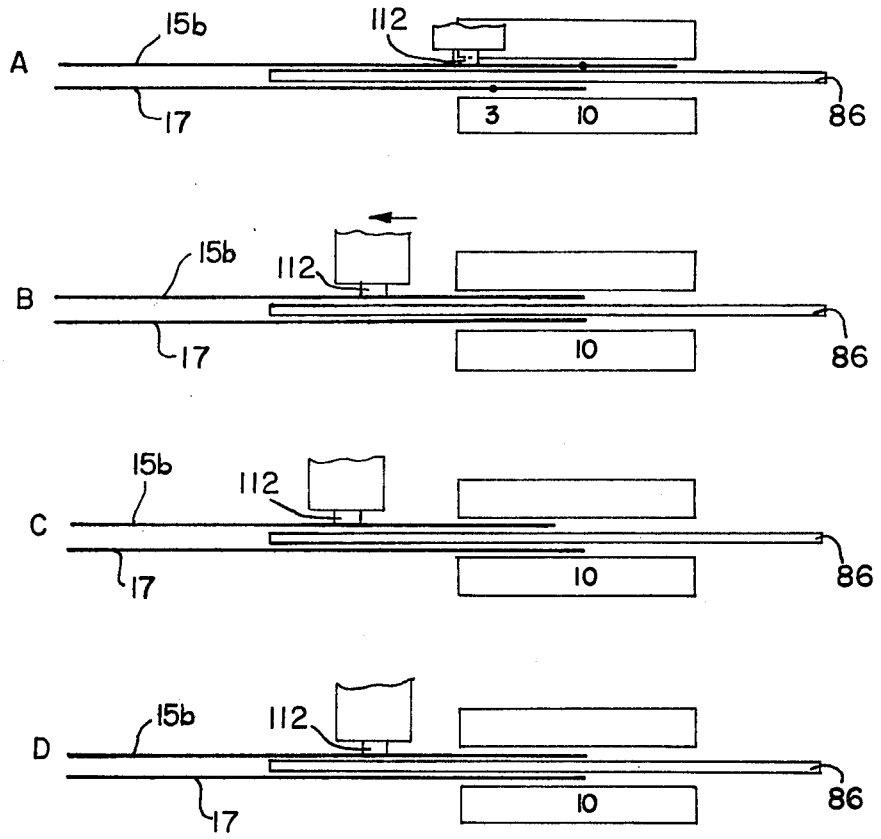
FIG. 5 is a partial schematic view representing the panel alignment steps when the top panel is longer.

Now for the sake of explanation, assume that the top ply 15*b* is the longer ply, which is the situation shown in FIG. 5 of the attached drawings. It should be recognized that in this particular embodiment, the microprocessor system on each work cycle assumes the top ply is the longer ply. And, as previously explained, only after a predetermined distance to the left does it determine that the top ply is shorter. Initially, the photo array is scanned, and an energy level value is generated for each sensor unit, and held in memory. The top ply 15*b* is then moved a predetermined distance to the left. The photo array is scanned to determine if there has been an energy level change in any one of the individual sensor units. If a change is detected, the panel is moved with the appropriate scanning until no change in any of the sensor units is detected. Movement is continued for two more sensor units in order to verify this reading. Once verified, the ply is moved back two sensor units. At this point, the side seaming operation is ready for initiation.

The next mode is known as the sew-up mode. There are various routines within the sew-up mode which can be selected at any given time during sew-up. The first step upon initiation of the sewing machine motor 32 is to counter balance out the aligner means 26. In addition to the balancing effect of spring 29, a current is put through the motor 38 such that the mass of the total aligner means 26 and support 42 is balanced to the point it exerts no drag on the fabric as it is accelerated by the feed dog presser foot combination. This function prevents any sharp jerk on the fabric ply by the sudden start-up of the sewing machine and its related mechanisms due to the mass of the aligner means 26 and related mechanisms. The speed of the fabric passing under the needle is controlled by the main motor 32 of the sewing machine. This speed is monitored in conjunction with the speed of the aligner drive motor 38. The two are coordinated by the microprocessor system such that the proper stretch or pull is maintained on the fabric plies 15 and 17 as they are joined. Thus, any mismatch in the panels is divided up over the entire length of the panels. At a predetermined point near the end of the sewing cycle, as the aligner means 26 approaches the needle, the edge guider means 14 is disengaged from the fabric plies and pulled away, to allow the aligner 26 to hold the fabric plies up to a point close as possible to the sewing needle. When the aligner means 26 moves to a predetermined position adjacent the needle, it is stopped. Simultaneously with the stopping, the fabric aligner clamping mean 50 is opened to allow the fabric to slide freely out of the aligner means 26 and under the needle means of the sewing machine. The aligner means 26 then moves back to the home position to begin the next cycle.

While in home mode, rest mode and sweep-down mode, the stack mode co-resides. In this mode, the sewing machine continues to sew until the cloth plate sensor is uncovered and at that point the stitch count begins. After a predetermined number of stitches, a clamp behind the needle comes down and secures the sewn fabric plys. Again, the microprocessor begins to count stitches and after a predetermined count it cuts the thread chain and turns the sewing machine off. The stacker means then stacks the garment and the work cycle is complete.

In summation, this particular embodiment includes the following series of steps. Prior to the loading of the fabric panel into the aligner means 26 the analog value of each individual sensor unit is generated. These values, which represent an uncovered state, are recorded for future use. A multiplexer and A/D converter are employed in the generation of this first set of values which are in the form of an 8 bit data word. After the fabric panels are positioned in the aligner means 26, a second set of analog values are generated to reflect the cover state. This second set of values is generated and recorded as the aligner means, carrying the photocell array, is sweeping down the side. The sweep down, at speed, continues until a sensor detects the shorter of the two fabric panels. Full stop occurs when both events happen; one a predetermined distance is moved and a predetermined portion of the photo array is uncovered. Both fabric panels are then clamped and a third set of analog values is generated and recorded. Initially, the microprocessor system assumes the top ply is the longer ply. If this is an incorrect assumption, it will recognize the error. Then, depending on which fabric panel is in fact long and which is shorter, a particular procedure is chosen to affect the alignment. Regardless of which ply is longer or shorter, all procedures involve the recalculation of analog values of the individual sensor units as a fabric panel is moved and a comparison of these recalculated values to covered values, uncovered values and values generated after clamping and just prior to the actual alignment. The fabric panel is moved until a particular predetermined combination of values is arrived at.

The fabric plies are then considered aligned and the mass of the total aligner means 26 and support 42 is balanced employing the spring 39. This occurs in synchronization with the start of the sewing cycle. During the sewing cycle, the upward movement of the aligner means by the drive motor is coordinated with the drive motor of the sewing machine in order to create the needed drag on the fabric panels to allow gathering and matching thereof. At a predetermined point adjacent the sewing machine, the plies are released in order to sew off the end portions. The aligner means 26 then returns to a predetermined position ready to start the next cycle.

In another embodiment of this invention, the micorprocessor system employs the signal from either the top or bottom end sensor means 116 or 120 as a way to determine which of the plies is longer and which is shorter. Thus, it can select either a modified "short top ply" routine or a modified "short bottom ply" routine. For example, if the top ply is short, as shown in FIG. 6, it is moved immediately to the right. All other steps are the same as previously described for short top ply alignment. If the top ply is longer, it is moved to the left the same as previously described until alignment is achieved.

Thus, it is apparent that there has been provided, in accordance with the invention, a fabric aligning apparatus that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What we claim is:

1. A method for positioning in a predetermined location a series of edges of fabric panels comprising the steps of:

generating the analog value of a photocell array means through a multiplexer and A/D converter when no portion of the photocell array means, which includes of a series of individual sensor unit means that comprises energy transmitter means and receptor means, is covered whereby an uninterrupted energy value is determined and recorded;

positioning a portion of the fabric panels between the energy transmitter means and receptor means of the photocell array means, tensioning said fabric panels causing the photocell array to be moved along a length of said fabric panels;

re-establishing the analog value of said photocell array through said multiplexer and A/D converter means when the transmission of energy between the transmitter means and receptor means of each sensor is interrupted by the presence of the fabric in combination with said uninterrupted energy value and recording that value;

detecting the trailing fabric edge of the shorter fabric ply;

causing a portion of said photocell array to run off said trailing fabric edge whereby terminating the interruption caused by the presence of said portion of fabric panel means with respect to some of said individual sensor means;

clamping the fabric ply means;

reading the amount of energy received by each receptor of said individual sensor unit means, generating analog values thereof and recording same values;

relaxing tension on the fabric panel means; scanning said photocell array, generating analog values while comparing said values to said three previously recorded analog values and simultaneously reorientating said trailing fabric edge, after each reorientation generating and comparing the analog values and; securing said fabric panel means when a particular pattern of analog values is detected; and starting a work sewing cycle on said fabric panel means.

2. The method of positioning in a predetermined location a series of edges of fabric panels of claim 1 wherein the top fabric panel is shorter comprising the steps of:

moving only the top panel a predetermined incremental distance in one direction;

scanning said photocell array after each step and comparing the analog value thereof to said three previously recorded anolog values;

reversing the direction of movement of said top panel after a predetermined number of steps and scanning said photocell array after each step; and moving said top panel while comparing the analog values being generated with the three previously recorded analog values until a particular pattern of analog values is detected.

3. The method of positioning in a predetermined location a series of edges of fabric panels of claim 1 wherein the top fabric panel is longer comprising the steps of:

moving only the top panel a predetermined incremental distance;

scanning said photocell array after each incremental move and comparing the analog value thereof to said previously recorded analog values after each step; and clamping said fabric panels when the analog value being generated forms a particular pattern with the three previously record analog values.

4. A method for aligning the bottom edges of two pant plys incident to the side seaming of the pant panels comprising the steps of:

employing a photocell array means comprised of a series of individual transmitter means and receiver means units in combination with a multiplexer and A/D converter means for generating a first analog value indicative of the background energy level for each of said units;

positioning said pant plys with respect to said photo array such that at least a portion of said plys interrupt the flow of energy between all of said transmitting means and receiving means units;

securing said pant plys with respect to said photocell array;

generating a second analog value indicative of an energy state wherein all the transmitter means and receiving means units have the flow of energy therebetween interrupted;

sweeping said photocell array down a side edge of said pant plys;

continuing said sweeping until the trailing edge of the shorter of said pant plys triggers an end sensor means, then moving a predetermined distance thereafter;

seizing said pant plys and stopping said sweep;

releasing tension on said fabric pant panels;

moving the trailing ends of said pant plys in a predetermined manner while simultaneously sweeping the photocell array, generating an analog value for each of said units means, and comparing the series of analog values to said analog value indicative of the background energy level and said series of analog values indicative of an energy state wherein all the transmitter means and receiving means are covered by the pant panels;

securing said trailing end means when a predetermined combination of analog values is achieved;

actuating the sewing machine means; and side seaming said pant plys.

5. The method of side seaming pant panels of claim 4 including the step comprising:

kicking-up the photocell array means in coordination with the activity of the sewing machine means whereby avoiding sudden tensioning of the pant ply means.

6. The method of side seaming pant panels of claim 4 including the step comprising:

coordinating the upward sweep of said photocell array means and the speed of the sewing machine means.

7. The method of side seaming pant panels of claim 4 including the step comprising:

during coordinating the upward sweep, causing said sufficient drag on the pant plys to allow gathering and matching of the pant plys.

8. Fabric edge aligner system comprising:

sewing machine means;

support means;

microprocessor means;

means for aligning the trailing edges of at least two fabric plies being fed to said sewing machine means, said aligner means including; top means for exerting pressure on the fabric plies at different points on the surface thereof;

means for controllably driving said means for exerting pressure along a given path parallel to the surface of said fabric plies, said driving means including a D.C. servomotor; and photoarray means arranged adjacent the fabric edge means to be sewn and said means for exerting pressure for controlling said driving means, said photoarray means having minimum space between the individual sensor unit means thereof whereby when said means for exerting pressure exerts pressure on said fabric ply the pressure is exerted such that the fabric ply may be moved along and generally perpendicular to the major axis of the photoarray means yet prevents it from pivoting one way or the other due to pressure imbalances.

9. Fabric edge aligner system for aligning fabric plies prior to the performance of a sewing function on predetermined edges thereof comprising:

a microprocessor means for controlling the activity of the fabric edge aligner system;

an aligner means including first means for exerting pressure on a first of said fabric plys at different points on the surface thereof;

means driving said pressure exerting means in a given plane generally parallel to that occupied by the fabric plies;

photo array means adjacent the fabric edges to be sewn, including a series of individual sensor unit means having a minimum amount of space therebetween;

means mounting and delivering force to said means for exerting pressure such that when actuated the pressure exerted thereby at the different points on the surface of the fabric ply will be equivalent so that the fabric ply will move continuously along the major axis of the photocell array perpendicularly thereto;

second means for exerting pressure on a second of said fabric plies;

first and second fabric ply edge sensor means whereby said first and second means for exerting pressure may be actuated independently;

means for supporting said aligner system means;

means for determining the position of said aligner means with respect to a fixed point;

motor means for moving the aligner along a predetermined path; and torque control means whereby the torque of said motor means may be controlled during the sewing cycle in response to information provided by said means for determining the position of said aligner means.

10. The aligner means of claim 9 wherein said means for exerting pressure includes:

a common source means for delivering compressed air;

a frame means carrying first and second pneumatic cylinder means, said cylinder means being adapted to receive said compressed air and each having rod end means which contact said fabric ply;

a screw means movably connected to said frame means whereby said first and second pneumatic means can be moved in a path generally parallel to the surface of said fabric plies; and a guide rod means movably connected to said frame means whereby upon actuation of said first and second pneumatic means a certain amount of freedom exists therebetween and said screw means to compensate for minor differences in the pressure exerted on fabric plies.

11. The aligner means of claim 10 wherein said first pneumatic cylinder means is spaced apart from said second pneumatic cylinder means; and said photocell array means is positioned equally distant therebetween.

* * * * *